US005397091A

United States Patent [19]

Tsuar

[11] Patent Number: 5,397,091

[45] Date of Patent: Mar. 14, 1995

[54] BLACKBOARD

[76] Inventor: Gwo-Nan Tsuar, No. 196, Ta-Wu Rd., Ping-Tung City, Taiwan, Prov. of China

[21] Appl. No.: 41,457

[22] Filed: Apr. 2, 1993

Related U.S. Application Data

[63] Continuation-in-part of Ser. No. 845,960, Mar. 4, 1992, abandoned.

[51] Int. Cl.[6] ..... B43L 1/00

[52] U.S. Cl. ..... 248/441.1; 16/374; 16/386; 434/417

[58] Field of Search ..... 434/408, 415, 417; 248/441.1; 16/356, 267, 374, 386

[56] References Cited

U.S. PATENT DOCUMENTS

| | | | |
|---|---|---|---|
| 169,649 | 11/1875 | Marshall | 434/417 |
| 328,177 | 10/1885 | Barnhart | 434/417 |
| 1,917,336 | 7/1933 | Spitz | 16/374 X |
| 3,363,341 | 1/1968 | Glassman | 434/417 |
| 4,437,839 | 3/1984 | Stempel | 434/417 |
| 4,942,271 | 7/1990 | Corsi et al. | 16/267 X |

FOREIGN PATENT DOCUMENTS

| | | | |
|---|---|---|---|
| 989677 | 4/1965 | United Kingdom | 16/356 |

*Primary Examiner*—Ramon O. Ramirez
*Assistant Examiner*—Derek J. Berger
*Attorney, Agent, or Firm*—Fitzpatrick, Cella, Harper & Scinto

[57] ABSTRACT

A blackboard includes a rectangular board member, a protective frame member provided on each side of the board member, and a tray connected to a lowermost one of the frame members and movable between an unfolded position for receiving erasers and writing implements and a folded position. The lowermost one of the frame members has a front side which is formed with a longitudinally extending retaining portion that confines a longitudinally extending space which is substantially L-shaped in cross-section. The tray has a rear side wall which is formed with a transversely and longitudinally extending rearward anchor projection that is substantially T-shaped in cross-section and that has a head portion which extends into the space.

1 Claim, 4 Drawing Sheets

BLACKBOARD

BACKGROUND OF THE INVENTION

1. Field of the Invention

This is a continuation-in-part application of U.S. patent application Ser. No. 07/845,960, filed Mar. 4, 1992, abandoned as of the filing date of this application.

The invention relates to a blackboard, more particularly to a blackboard with a foldable tray.

2. Description of the Related Art

Referring to FIG. 1, a conventional blackboard (1) is shown to comprise a rectangular board member (10) and a protective frame member (11) disposed on each side of the board member (10). A tray (12) is formed on a lowermost one of the frame members (11) and is used to receive erasers and writing implements. The conventional blackboard (1) requires a relatively large packaging volume because of the width of the tray (12), as shown in FIG. 2. The transport and packaging costs of the conventional blackboard (1) are thus relatively high.

FIG. 3 is an illustration of a second example of a conventional blackboard (2). The tray (13) is separate from the lowermost frame member (14), thereby reducing the packaging volume of the conventional blackboard (2). A catch (15) is provided on the rear side of the frame member (14) and is used to join the tray (13) and the frame member (14) when the conventional blackboard (2) is in use. The blackboard (2) is inconvenient to use because of the need to assemble the tray (13) on the frame member (14).

A third example of a conventional blackboard (3) is shown in FIG. 4. The blackboard (3) has a lowermost frame member (21) which has a front side that is formed with a longitudinally extending retaining portion that defines a longitudinally extending rounded groove (211). The blackboard (3) further has a tray (22) which has a rear side that is provided with a longitudinally extending cylindrical lug (221) which is rotatably received in the groove (211). The lug (221) permits upward rotation of the tray (22) from an unfolded position, wherein the tray (22) is supported by the retaining portion so as to receive writing implements and the like, to a folded position. The tray (22) is folded so as to reduce the packaging volume of the blackboard (3), thereby reducing the transport and packaging costs of the blackboard (3).

Some of the drawbacks of the conventional blackboard (3) are as follows:

1. The material cost of the blackboard (3) is relatively high. Note that the lowermost frame member (21) is usually made of aluminum. The groove-and-lug connection between the frame member (21) and the tray (22) requires more raw material and yields more scrap.

2. Note that the tray (22) contacts the frame member (21) at lines (A, B) on the retaining portion of the latter whenever the tray (22) is folded or unfolded. Since aluminum is a relatively soft material, scars are formed at the lines.(A, B) on the tray (22) after repeated folding and unfolding movement of the tray (22), thereby diminishing the aesthetic appeal of the blackboard (3).

SUMMARY OF THE INVENTION

Therefore, the main objective of the present invention is to provide a blackboard with a foldable tray which permits a reduction in the packaging volume in order to reduce the transport and packaging costs of the blackboard and which utilizes less raw material in order to reduce the material cost of the blackboard.

Another objective of the present invention is to provide a blackboard with a foldable tray which minimizes the formation of scar lines on the tray even after repeated folding and unfolding movement of the tray.

Accordingly, a blackboard of the present invention includes a rectangular board member, a protective frame member provided on each side of the board member, and a tray connected to a lowermost one of the frame members and movable between an unfolded position for receiving erasers and writing implements and a folded position.

The lowermost one of the frame members has a front side which is formed with a longitudinally extending retaining portion that includes a first flange extending frontwardly from the front side, a second flange similarly extending frontwardly from the front side below the first flange and being longer than the first flange, a third flange extending downwardly from a distal end of the first flange, a fourth flange extending upwardly from a distal end of the second flange, and a fifth flange extending rearwardly from a distal end of the fourth flange. The retaining portion confines a longitudinally extending space which is substantially L-shaped in cross-section and which is accessible via an opening that is defined by the distal ends of the third and fifth flanges.

The tray has a rear side wall which is formed with a transversely and longitudinally extending rearward anchor projection that is substantially T-shaped in cross-section and that has a head portion which extends into the space via the opening.

The rear side wall abuts against the fourth flange, the anchor projection is supported by the fifth flange, and the head portion is retained between the front side of the frame member and the third flange when the tray is in the unfolded position.

The anchor projection abuts against the third flange, and the head portion is retained between the second and fifth flanges when the tray is in the folded position.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 5:
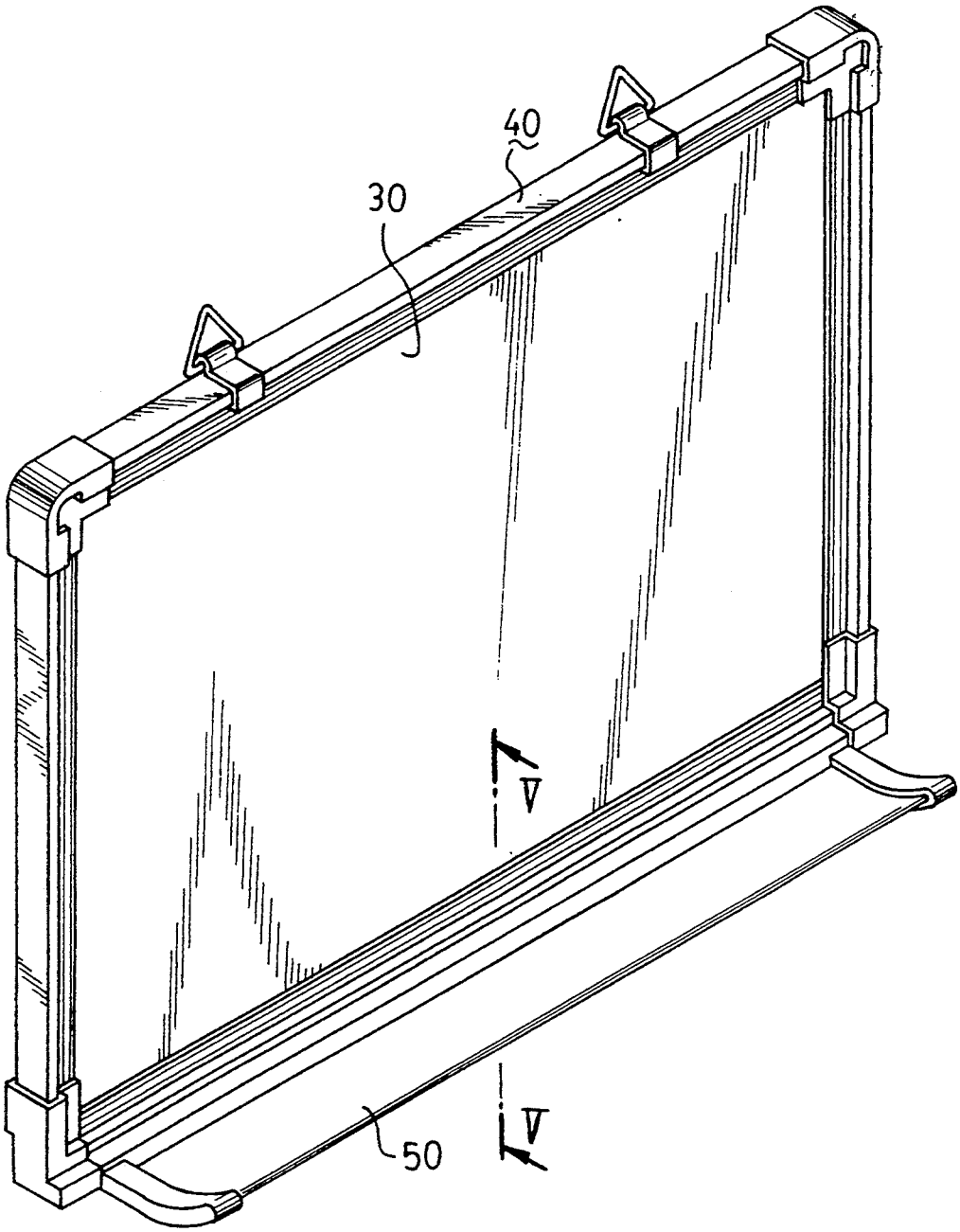
FIG. 5 is a perspective view of the preferred embodiment of a blackboard according to the present invention.
Figure 6:
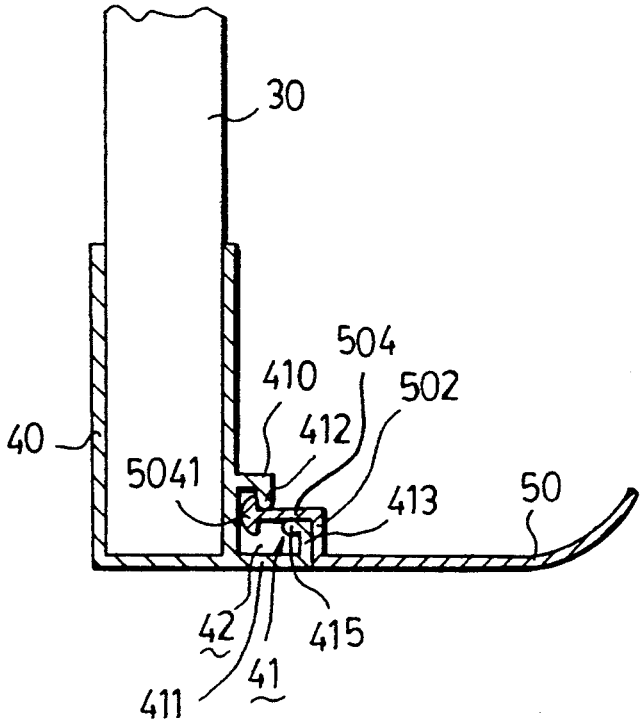
FIG. 6 is a VI—VI section of the preferred embodiment as shown in FIG. 5.

Referring to FIGS. 5 and 6, the preferred embodiment of a blackboard according to the present invention is shown to comprise a rectangular board member (30)

which may be a white board or a black board, a protective frame member (40) disposed on each side of the board member (30), and an elongated tray (50) extending from a lowermost one of the frame members (40) and used to receive erasers and writing implements.

The lowermost frame member (40) has a front side which is formed with a longitudinally extending retaining portion (41). The retaining portion (41) includes a first flange (410) which extends frontwardly from the front side of the lowermost frame member (40) and a second flange (411) which similarly extends frontwardly from the front side of the lowermost frame member (40) below the first flange (410). A third flange (412) extends downwardly from a distal end of the first flange (410). The second flange (411) is longer than the first flange (410). A fourth flange (413) extends upwardly from a distal end of the second flange (411). A fifth flange (415) extends rearwardly from a distal end of the fourth flange (413). The retaining portion (41) confines a longitudinally extending space (42) which is substantially L-shaped in cross-section and which is accessible via an opening that is defined by the distal ends of the third and fifth flanges (412,415).

The tray (50) has a rear side wall (502) which is formed with a transversely and longitudinally extending rearward anchor projection (504) that extends into the space (42) and that is substantially T-shaped in cross-section.

When the tray (50) is in an unfolded position, the rear side wall (502) abuts against the fourth flange (413) of the retaining portion (41), as shown in FIG. 6. The anchor projection (504) is supported by the fifth flange (415) and has a head portion (5041) which is retained Between the front side of the lowermost frame member (40) and the third flange (412).

Figure 7:
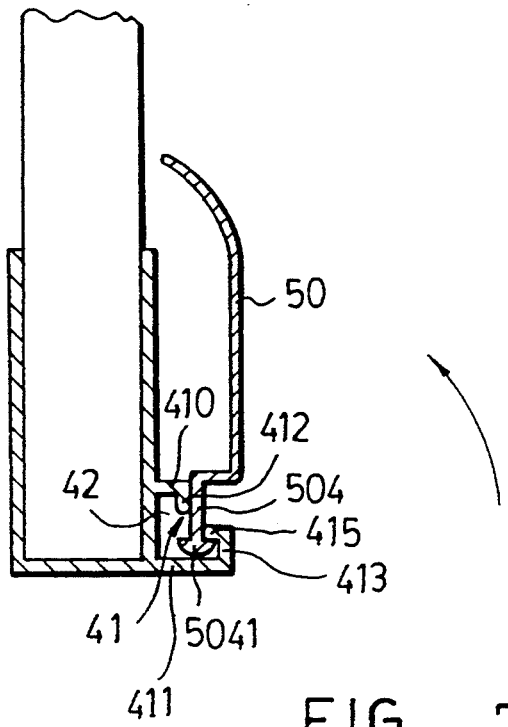
FIG. 7 is an illustration of the preferred embodiment when a tray thereof is folded.

The tray (50) is rotated upwardly so as to place the tray (50) in the folded position, as shown in FIG. 7. When the tray (50) is in the folded position, the anchor projection (504) abuts against the third flange (412). The head portion (5041) of the anchor projection (504) is retained between the second and fifth flanges (411, 415). It has thus been shown that the head portion (5041) of the anchor projection (504) is retained in the space (42) regardless of the direction of the movement of the tray (50).

The advantages and characterizing features of the blackboard of the present invention are as follows:

1. The tray is foldable, and thus, the packaging volume of the blackboard can be reduced so as to lower the packaging and transport costs of the same.

Figure 1:
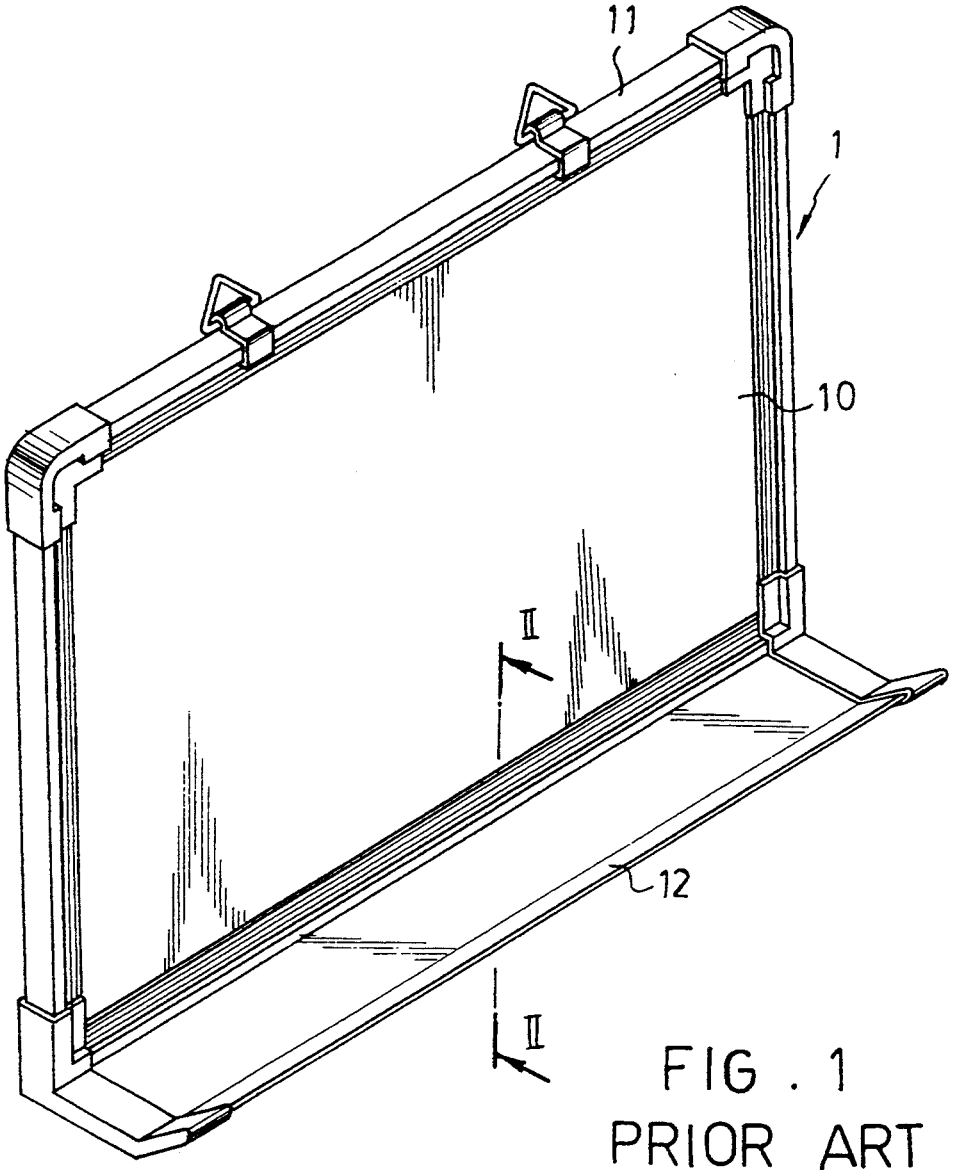
FIG. 1 PRIOR ART
FIG. 1 is a perspective view of a first example of a conventional blackboard.
Figure 2:
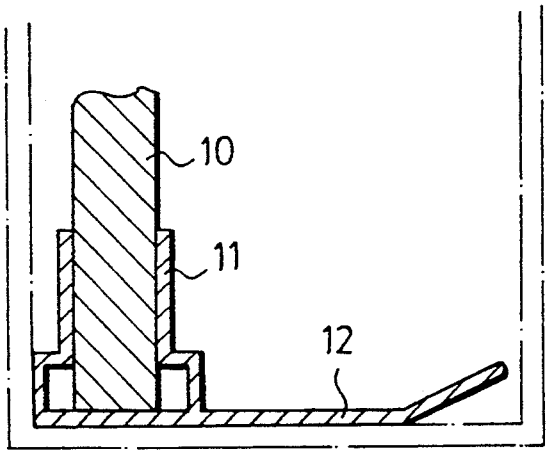
FIG. 2 PRIOR ART
FIG. 2 is a II—II section of the conventional blackboard shown in FIG. 1.
Figure 3:
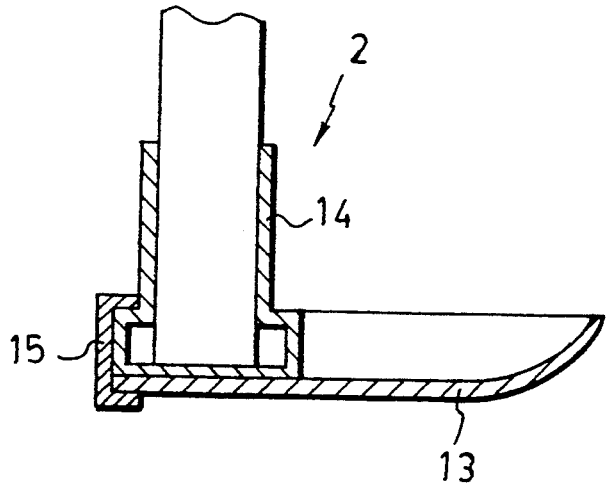
FIG. 3 PRIOR ART
FIG. 3 is an illustration of a second example of a conventional blackboard.
Figure 4:
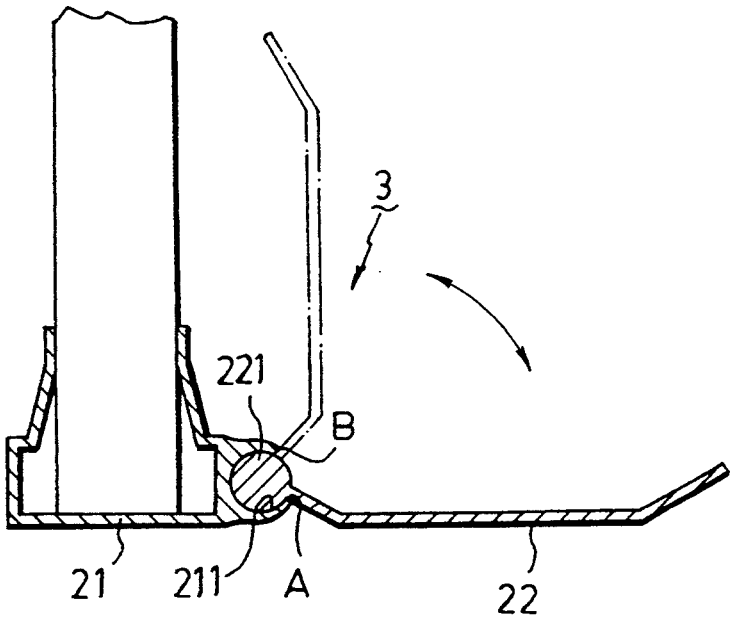
FIG. 4 PRIOR ART
FIG. 4 is an illustration of a third example of a conventional blackboard.

2. Friction between the head portion (5041) and the retaining portion (41) on the lowermost frame member (40) is relatively small since the contact area therebetween is less than that between the rounded groove (211) and the cylindrical lug (221) of the conventional blackboard (3) shown in FIG. 4. Movement of the tray (50) between the folded and unfolded positions can be easily accomplished without decreasing the load bearing capacity of the tray (50).

3. The material cost of the preferred embodiment is lower because the anchor projection (504) requires less raw material.

4. Little or no scar lines are formed on the tray (50) after repeated folding and unfolding movement of the tray (50).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A blackboard including a board member, a protective frame member provided on each side of the board member, and a tray connected to a lowermost one of said frame members and movable between an unfolded position for receiving erasers and writing implements and a folded position, characterized by:

said lowermost one of said frame members having a front side which is formed with a longitudinally extending retaining portion that includes a first flange extending frontwardly from said front side, a second flange similarly extending frontwardly from said front side below said first flange and being longer than said first flange, a third flange extending downwardly from a distal end of said first flange, a fourth flange extending upwardly from a distal end of said second flange, and a fifth flange extending rearwardly from a distal end of said fourth flange;

said retaining portion defining a longitudinally extending space which is substantially L-shaped in cross-section and which is accessible via an opening that is defined by the distal ends of said third and fifth flanges;

said tray having a rear side wall and having a transversely and longitudinally extending rearward anchor projection formed on said rear side wall, said rearward anchor projection being substantially T-shaped in cross-section and having a head portion which extends into the space defined by said retaining portion via the opening defined by the distal ends of said third and fifth flanges;

said rear side wall abutting against said fourth flange, said anchor projection being supported by said fifth flange, and said head portion being retained between said front side and said third flange when said tray is in the unfolded position; and said anchor projection abutting against said third flange, and said head portion being retained between said second and fifth flanges when said tray is in the folded position.

* * * * *